United States Patent [19]

Inoue et al.

[11] Patent Number: 4,587,456

[45] Date of Patent: May 6, 1986

[54] IMAGE PICKUP TUBE TARGET

[75] Inventors: Eisuke Inoue; Yasuhiko Nonaka; Masanao Yamamoto, all of Mobara, Japan

[73] Assignee: Hitachi, Ltd., Tokyo, Japan

[21] Appl. No.: 571,473

[22] Filed: Jan. 17, 1984

[51] Int. Cl.[4] ..... H01J 31/10; H01J 31/26

[52] U.S. Cl. ..... 313/366; 313/386

[58] Field of Search ..... 313/366.8, 384, 385, 313/386

[56] References Cited

U.S. PATENT DOCUMENTS 4,040,985 8/1977 Shidara et al. ..... 313/386 X
4,330,733 5/1982 Shidara et al. ..... 313/386
4,463,279 1/1984 Shidara et al. ..... 313/386

*Primary Examiner*—Palmer C. DeMeo
*Assistant Examiner*—Sandra L. O'Shea
*Attorney, Agent, or Firm*—Charles E. Pfund

[57] ABSTRACT

An image pickup tube target includes a Se-As-Te photoconductive layer whose arsenic concentration changes in a direction of thickness of the Se-As-Te photoconductive layer, a carrier extraction layer having a high arsenic concentration and being contiguous to the Se-As-Te photoconductive layer, a capacitive layer having a low arsenic concentration and being contiguous to the carrier extraction layer, a doped layer obtained by doping $In_2O_3$, $MoO_2$ or a mixture thereof in an interface between the carrier extraction layer and the capacitive layer.

9 Claims, 7 Drawing Figures

IMAGE PICKUP TUBE TARGET

BACKGROUND OF THE INVENTION

I. Field of the Invention

The present invention relates to an image pickup tube target and, more particularly, to a structure of a Se-As-Te type chalcogen photoconductive film (Saticon film) with improved sticking characteristics.

II. Description of the Prior Art

FIG. 1 shows a section of a main part of a conventional image pickup tube target and a concentration distribution of selenium, arsenic and tellurium as major constituents of a photoconductive film.

Referring to FIG. 1, a transparent conductive film 2 containing $SnO_2$ or $In_2O_3$ as a major constitutent is formed on the rear major surface of a disc-like transparent glass substrate 1. A very thin N-type transparent $CeO_2$ conductive film 3 serving as a blocking layer is formed on the rear major surface of the transparent conductive film 2. A P-type photoconductive film 4 comprising a P-type Se-As-Te amorphous semiconductor film is formed on the rear major surface of the N-type transparent conductive film 3. A P-type $Sb_2S_3$ photoconductive film 5 serving as a beam landing layer is formed on the rear major surface of the P-type photoconductive film 4. The P-type photoconductive film 4 consists of first, second and third P-type photoconductive layers 4*a*, 4*b* and 4*c*. The first P-type photoconductive layer 4*a* comprises a P-type Se-As amorphous semiconductor film having an Se concentration of 97 to 88 wt % and an As concentration of 3 to 12 wt % and is formed on the rear major surface of the N-type transparent conductive film 3 to have a thickness of 30 to 60 nm. The second P-type photoconductive layer 4*b* comprises a P-type Se-As-Te amorphous semiconductor film having an Se concentration of about 67 wt %, an As concentration of 3 wt %, and a Te concentration of about 30 wt % and is formed on the rear major surface of the first P-type photoconductive layer 4*a* to have a thickness of about 60 nm. The third P-type photoconductive layer 4*c* is formed on the rear major surface of the second P-type photoconductive layer 4*b* such that a total thickness of the multilayer film 4 is set to be about 3900 nm, for example. The third P-type photoconductive layer 4*c* comprises a P-type Se-As amorphous semiconductor film wherein in the Se-As concentration distribution, the As concentration continuously changes from 20 to 30 wt % to 3±2 wt % over a thickness of 45±20 nm which starts from the interface between the second and third P-type photoconductive layers 4*b* and 4*c*. The 3±2 wt % As concentration remains unchanged as the thickness increases. The P-type photocoductive film 5 is formed on the rear major surface of the multilayer film 4. A light beam 6 is incident on the front major surface of the glass substrate 1, and a scanning electron beam 7 is supplied to the P-type photoconductive film 5.

In the image pickup tube target having the structure described above, the gradient As concentration layer as part of the third P-type photoconductive layer 4*c* serves as a carrier extraction layer for effectively and stably extracting carriers generated in the Te layer of the second P-type photoconductive film 4*b*. The gradient As concentration layer also serves to prevent the Te layer from being diffused, thereby preventing degradation of the voltage-photocurrent characteristic (V-I characteristic) forming part of evaluation criterion. The uniform 3±2 wt % As concentration layer contiguous to the gradient As concentration layer serves as a capacitive layer for storage of the carriers. The P-type photoconductive layer 4*c* including the gradient As concentration layer and the uniform As concentration layer is the most important layer to determine quality of the electrical characteristics of the target in use.

However, when a highly luminous object or a still object is picked up with an image pickup tube having the above-mentioned target, a so-called sticking phenomenon occurs wherein a previous image sticks to the present image. The occurrence of this phenomenon is mainly dependent on the P-type photoconductive film 4. Especially, when a Saticon film is used, the sticking phenomenon largely depends on the content of highly concentrated arsenic in the third P-type photoconductive layer 4*c*. With the content of arsenic decreased, the sticking can be suppressed but sufficient extraction of the carriers from the Te layer cannot be sustained. As a result, a practically sufficient signal current cannot be obtained.

SUMMARY OF THE INVENTION

It is, therefore, an object of the present invention to provide an image pickup tube target capable of suppressing the sticking phenomenon by providing an indium-doped layer containing indium oxide, substantially free from the sticking phenomenon, to a slight extent that a decrease in carrier extraction effect due to a decrease in arsenic content of the high arsenic concentration layer can be compensated for.

In order to achieve the above object of the present invention, there is provided an image pickup tube target comprising: a transparent glass substrate; a first transparent conductive film formed on a rear major surface of said transparent glass substrate; a second transparent conductive film serving as a blocking layer and formed on a rear major surface of said first transparent conductive film; a multilayer photocoductive film which has first to fourth amorphous semiconductor layers containing selenium, arsenic and tellurium as major constituents, which is formed on a rear major surface of said second transparent conductive film to have a predetermined thickness and which has an arsenic concentration distribution changing in a direction of thickness of said multilayer photoconductive film; a single photoconductive film formed on a rear major surface of said fourth amorphous semiconductor layer of said multilayer photoconductive film; and a layer doped with a dopant having negative space charges in selenium and formed across an interface between said third and fourth amorphous semiconductor layers of said multilayer photoconductive film.

DETAILED DESCRIPTION OF THE PREFERRED EMBODIMENTS

Figure 1:
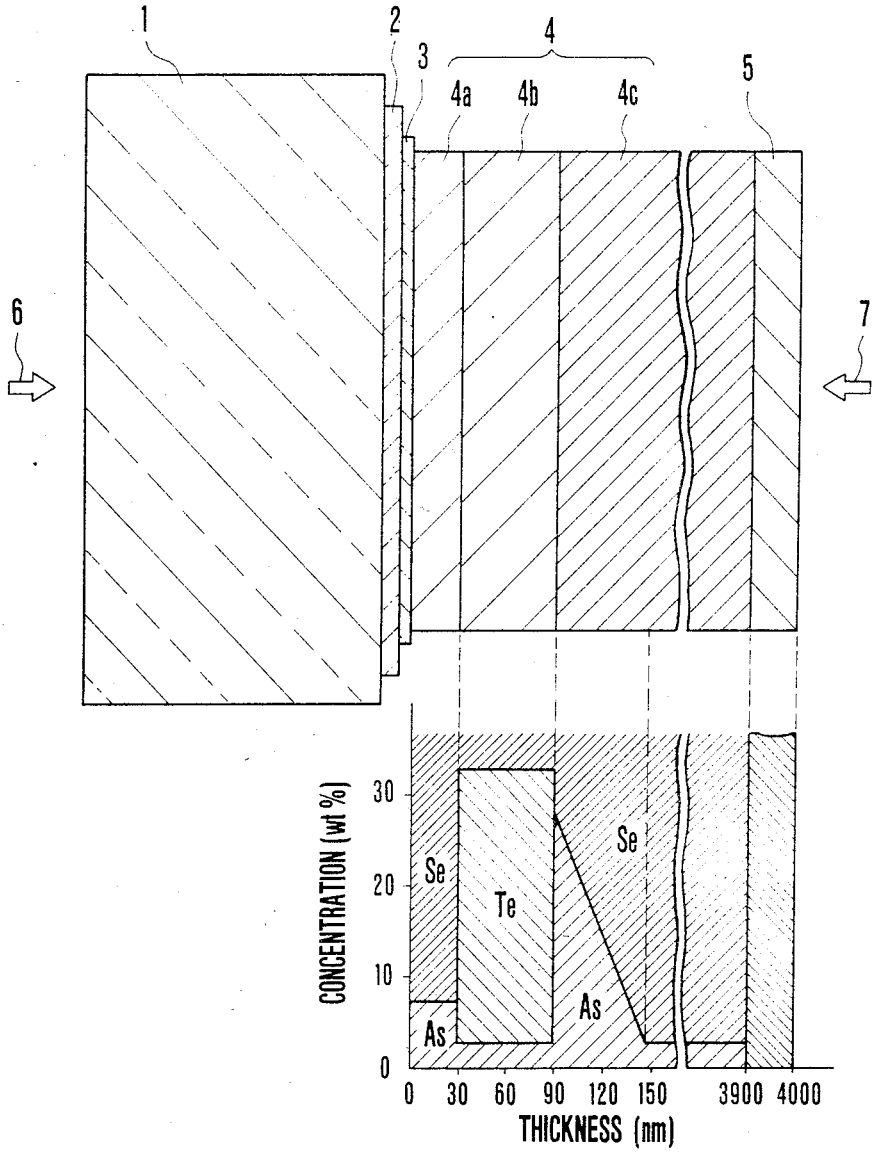
FIG. 1 PRIOR ART
FIG. 1 is a diagram for explaining a conventional image pickup tube target.
Figure 2:
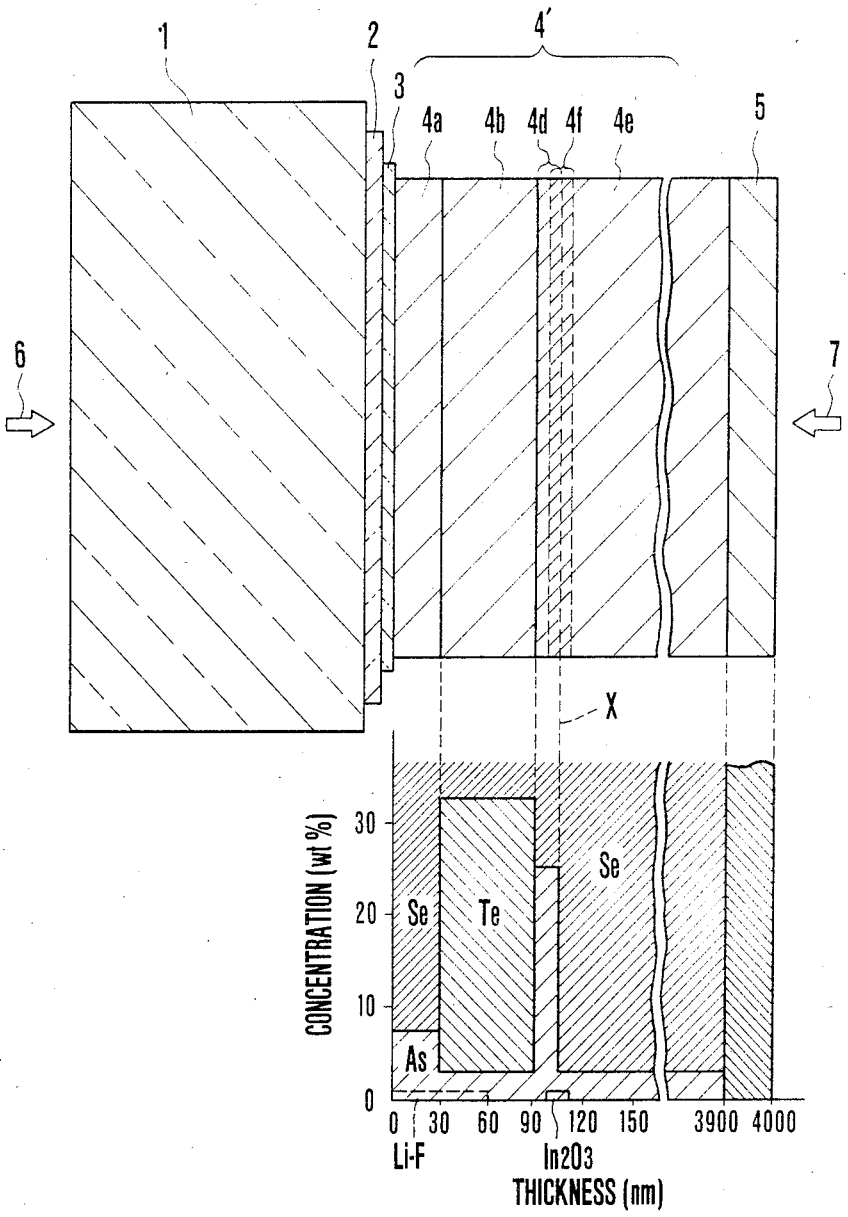
FIG. 2 is a diagram for explaining an image pickup tube target according to an embodiment of the present invention.

FIG. 2 shows a section of a main part of an image pickup tube target according to an embodiment of the present invention, and a diagram of a Se-As-Te concentration distribution. In FIGS. 1 and 2, the same reference numerals are used to denote the same parts, a detailed description of which will be omitted.

Referring to FIG. 2, a third P-type photoconductive layer 4*d* as a carrier extraction layer is formed on the rear major surface of a second P-type photoconductive layer 4*b* as a carrier generating layer to have a thickness of 12±6 nm. The layer 4*d* comprises a P-type Se-As amorphous semiconductor film having a concentration distribution such that the Se concentration is 75±5 wt % and the As concentration is 25±5 wt %. A fourth P-type photoconductive layer 4*e* serving as a capacitive layer is formed on the rear major surface of the third P-type photoconductive layer 4*d* to have a thickness such that a multilayer film 4' has a total thickness of, for example, about 3900 nm. The fourth P-type photoconductive layer 4*e* comprises a P-type Se-As amorphous semiconductor film having a concentration such that the Se concentration is 97±2 wt % and the As concentration is 3±2 wt %. $In_2O_3$ having negative space charges in selenium is doped to a thickness of 3 to 30 nm at a concentration of 100 to 3,000 wtppm across an interface between the third and fourth P-type photoconductive layers 4*d* and 4*e*, so that an $In_2O_3$-doped layer 4*f* is formed not to contact the Te layer of the second P-type photoconductive layer 4*b*. Although the layer 4*f* is illustrated as doped with $In_2O_3$, other dopants such as $MoO_2$ or a mixture of $In_2O_3$ and $MoO_2$ which have negative space charges in selenium may also be used.

In the P-type multilayer film 4' having the structure described above, the arsenic content (concentration x thickness) in the third P-type photoconductive layer 4*d* as the carrier extraction layer is decreased to ⅓ to 1/6 of that of the conventional image pickup tube target. In addition, the doped layer 4*f* of $In_2O_3$, $MoO_2$ or mixture thereof which has negative space charges in selenium and which has carrier extraction capability is formed across the interface between the third and fourth P-type photoconductive layers 4*d* and 4*e*, so that the carrier extraction efficiency is greatly improved and the sticking phenomenon can be greatly decreased. In this case, when the arsenic content of the carrier extraction layer is decreased to about 1/6 or lower, the effect for preventing tellurium from being diffused from the second P-type photoconductive layer 4*b* is impaired. Therefore, the arsenic content in a rectangular concentration distribution cannot be decreased to about 1/6 or lower.

Figure 3:
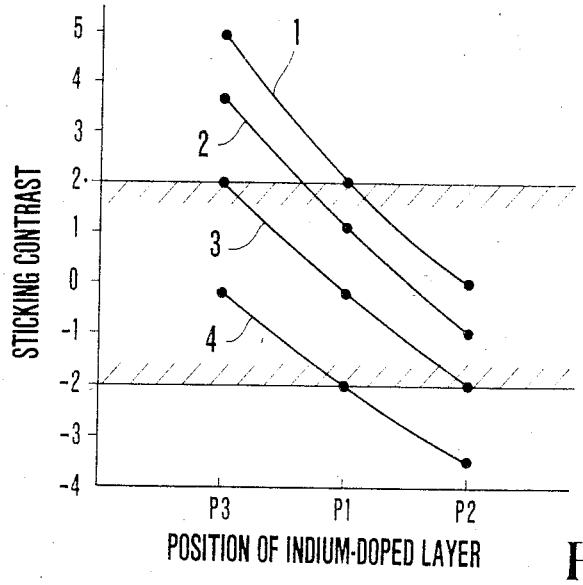
FIG. 3 is a graphical representation useful in explaining effects of the present invention.
Figure 4C:
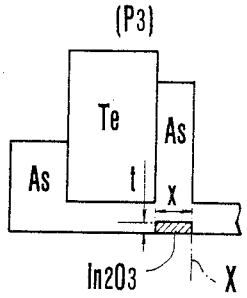
FIGS. 4*a* to 4*c* are diagrams showing various positions of the indium-doped layer.
Figure 4A:
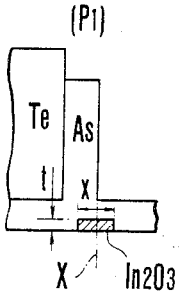
Figure 4B:
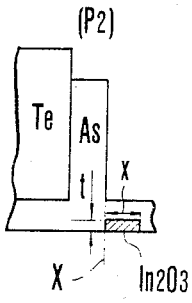

FIG. 3 shows the relation between the position of the indium-doped layer 4*f* and the sticking contrast for various $In_2O_3$ doping contents (wtppm.nm) as defined by concentration y (wtppm)×thickness x (nm). Curves 1 to 4 correspond to doping contents of 90000 wtppm.nm (3000 wtppm×30 nm), 15000 wtppm.nm (1000 wtppm×15 nm), 8000 wtppm.nm (750 wtppm×12 nm) and 300 wtppm.nm (100 wtppm×3 nm), respectively. Points P1, P2 and P3 correspond to positions of the indium-doped layer as shown in FIGS. 4*a*, 4*b* and 4*c*, respectively. It will then be appreciated that when the indium-doped layer is formed across the interface X, preferably, substantially centered to the interface X, all the characteristic curves 1 to 4 representative of 100 to 3000 wtppm $In_2O_3$ doping concentrations and 3 to 30 nm indium-doped layer thicknesses fall in an allowable sticking contrast range as hatched.

Figure 5:
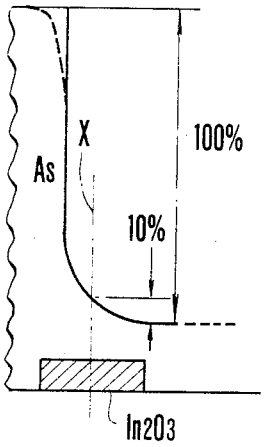
FIG. 5 is a diagram showing an actual contour of the interface between the third and fourth amorphous semiconductor layers.

In the foregoing embodiment, the $In_2O_3$ layer is formed in a thickness region having as a center the interface or boundary X where the arsenic content (25±5 wt %) of the third P-type photoconductive layer 4*d* is abruptly decreased to the arsenic content (3±2 wt %) of the fourth P-type photoconductive layer 4*e*. In effect, however, the arsenic content gradually decreases as shown at solid line or dotted line in FIG. 5. In this case, the $In_2O_3$ layer may be formed in a thickness region having as a center a point where the arsenic concentration of the third P-type photoconductive layer 4*d* is decreased to 10% of an arsenic concentration difference between the third and fourth P-type photoconductive layers 4*d* and 4*e*. This point is also defined as interface or boundary X in this application. Further, the total thickness of P-type photoconductive layer 4' is not limited to 3900 nm and the effects of the present invention can be attained irrespective of the total thickness. For example, the total thickness may be 5900 nm with the photoconductive layer 5 ending at 6000 nm.

In a modification of the embodiment described above, $In_2O_3$, $MoO_2$ or a mixture thereof is doped in a high-light sticking prevention Saticon film (Japanese Patent Application No. 55-157084) doped with Li-F across an interface between the first and second P-type photoconductive layers 4*a* and 4*b* as shown at dotted line in FIG. 2, to form a doped layer 4*f*. In this modification, the sticking phenomenon can be prevented in the same manner as in the above embodiment. In addition, the sticking phenomenon which results from picking up of a highly luminous object can also be suppressed.

As has been described, according to the image pickup tube target of the present invention, the sticking phenomenon due to highly luminous incident light can be greatly decreased to obtain a high-quality image.

The present invention is not limited to the particular embodiments described above, and various changes and modifications may be made within the spirit and scope of the present invention.

What is claimed is:

1. An image pickup tube target comprising:

a transparent substrate;

a first transparent conductive film formed on a rear major surface of said transparent substrate;

a second transparent conductive film serving as a blocking layer and formed on a rear major surface of said first transparent conductive film;

a multilayer photoconductive film which has first amorphous semiconductor layer mainly made of Se and As, second amorphous semiconductor layer mainly made of Se, Te, and As, third amorphous semiconductor layer mainly made of Se and As, and fourth amorphous semiconductor layer mainly made of Se and As with an average concentration of As being lower than that in third layer, in the order named, which is formed on a rear major surface of said second transparent conductive film to have a predetermined thickness;

a single photoconductive film formed on a rear major surface of said fourth amorphous semiconductor layer of said multilayer photoconductive film; and a layer doped with a dopant having negative space charges in selenium and formed across an interface between said third and fourth amorphous semiconductor layers of said multilayer photoconductive film, not to contact said second amorphous semiconductor layer.

2. An image pickup tube target according to claim 1 wherein the dopant is $In_2O_3$.

3. An image pickup tube target according to claim 1 wherein dopant is $MoO_2$.

4. An image pickup tube target according to claim 1 wherein dopant is a mixture of $In_2O_3$ and $MoO_2$.

5. An image pickup tube target according to claim 1, wherein said interface is a boundary where the arsenic concentration is abruptly decreased.

6. An image pickup tube target according to claim 1, wherein said interface is a boundary where the arsenic concentration is decreased to about 10% of an arsenic concentration difference between said third and fourth amorphous semiconductor layers when the arsenic concentration gradually changes therebetween.

7. An image pickup tube target according to claim 1, 5 or 6, wherein said doped layer is centered to said interface.

8. An image pickup tube target according to claim 7, wherein said doped layer is formed such that indium oxide is doped to a concentration of 100 to 3,000 wtppm to a thickness falling within a range of 3 to 30 nm.

9. An image pickup tube target according to claim 1 further comprising an Li-F layer formed across an interface between said first and second amorphous semiconductor layers.

* * * * *